US008742992B2

(12) United States Patent
Kai et al.

(10) Patent No.: US 8,742,992 B2
(45) Date of Patent: Jun. 3, 2014

(54) PLANAR INVERTED F ANTENNA

(75) Inventors: Manabu Kai, Kawasaki (JP); Teruhisa Ninomiya, Kawasaki (JP); Takahiro Koharagi, Tokyo (JP); Hiroaki Kawasumi, Tokyo (JP); Katsumi Kobayashi, Tokyo (JP); Takuji Furusawa, Tokyo (JP); Masaharu Nozawa, Shizuoka (JP); Masashi Kuwahara, Fukushima (JP)

(73) Assignee: Fujitsu Limited, Kawasaki (JP)

( * ) Notice: Subject to any disclaimer, the term of this patent is extended or adjusted under 35 U.S.C. 154(b) by 138 days.

(21) Appl. No.: 13/443,505

(22) Filed: Apr. 10, 2012

(65) Prior Publication Data

US 2012/0268326 A1 Oct. 25, 2012

(30) Foreign Application Priority Data

Apr. 25, 2011 (JP) ..... 2011-097005

(51) Int. Cl.
*H01Q 1/38* (2006.01)
*H01Q 1/24* (2006.01)

(52) U.S. Cl.
CPC . *H01Q 1/38* (2013.01); *H01Q 1/243* (2013.01)
USPC ..... 343/700 MS; 343/702

(58) Field of Classification Search
CPC ..... H01Q 1/38; H01Q 1/243
USPC ..... 343/702, 700 MS, 846
See application file for complete search history.

(56) References Cited

U.S. PATENT DOCUMENTS

| | | | | |
|---|---|---|---|---|
| 7,352,329 | B2 | 4/2008 | Chung et al. | |
| 7,501,987 | B2 | 3/2009 | Wang et al. | |
| 7,782,270 | B2 | 8/2010 | Chung et al. | |
| 2007/0171130 | A1 | 7/2007 | Chung et al. | |
| 2008/0309563 | A1 | 12/2008 | Wang et al. | |
| 2009/0115664 | A1 | 5/2009 | Chung et al. | |
| 2009/0289859 | A1 | 11/2009 | Pan | |
| 2010/0194642 | A1* | 8/2010 | Rao et al. | 343/700 MS |
| 2010/0277376 | A1* | 11/2010 | Chakam et al. | 343/702 |
| 2013/0069841 | A1* | 3/2013 | Lee et al. | 343/846 |

FOREIGN PATENT DOCUMENTS

| | | |
|---|---|---|
| EP | 1950833 | 7/2008 |
| EP | 2056396 | 5/2009 |
| JP | 2008-263468 | 10/2008 |
| TW | 200849719 A | 12/2008 |
| TW | 200922002 A | 5/2009 |

OTHER PUBLICATIONS

Extended European search report with the European search opinion issued for corresponding European Patent Application No. 12159841.1 dated Jul. 25, 2012.

First Notificaiton of Office Action issued for corresponding Chinese Patent Application No. 201210124809.6, dated Dec. 23, 2013, with an English translation.

* cited by examiner

*Primary Examiner* — Hoanganh Le
(74) *Attorney, Agent, or Firm* — Myers Wolin, LLC

(57) ABSTRACT

In a planar inverted F antenna, a second radiation element is provided parallel to the GND surface and extending partially with respect to a first radiation element in a longitudinal direction, so as to substantially increase a width of the first radiation element in the vicinity of a power supply section.

8 Claims, 14 Drawing Sheets

Viewed from Arrow A

PLANAR INVERTED F ANTENNA

CROSS-REFERENCE TO RELATED APPLICATION

This application is based upon and claims the benefit of priority of the prior Japanese Patent Application No. 2011-097005 filed on Apr. 25, 2011 in Japan, the entire contents of which are hereby incorporated by reference.

FIELD

The embodiments discussed herein are related to a planar inverted F antenna.

BACKGROUND

Planar inverted F antennas have been used as antennas for a wireless communication unit provided on a circuit board of communication modules, e.g., mobile telephones, wireless LAN (Local Area Network) appliances. These antennas are build-in antennas provided on a circuit board with a relatively low profile, employing the circuit board for grounding. Planar inverted F antennas are applied to various types of communication modules, since planar inverted F antennas include a plurality of planar elements, which can be manufactured from low-cost metal plates, and are easily attached to a circuit board.

For example, the technique related to Planar inverted F antennas is disclosed in following Patent Reference 1.

Patent Reference 1: Japanese Laid-open Patent Publication No. 2008-263468

As an example of a planar inverted F antenna, a planar inverted F antenna 200 is depicted in FIG. 1.

The planar inverted F antenna 200 includes a planar grounding element 100 that is to be placed on a GND surface of a circuit board, a planar radiation element 120 (having a length L1 and a height H) extending substantially parallel to the grounding element 100, and planar short-circuit elements 140 and 160 that short-circuit the grounding element 100 and the radiation element 120. A power supply section F that applies wireless signals from the circuit board is provided at the short-circuit element 160. The planar inverted F antenna 200 has literally an inverted F geometry.

FIG. 2 indicates the planar inverted F antenna 200, provided on a GND surface of the circuit board. As depicted in FIG. 2, the grounding element 100 of the planar inverted F antenna 200 is attached to the GND surface having a size of K1×K2 (on the X-Z plane). As depicted in FIG. 2, the planar inverted F antenna 200 may be provided at the end of circuit board so as not to interfere with other components provided on the circuit board.

FIGS. 3A and 3B indicate electromagnetic field simulator results of the planar inverted F antenna 200, wherein FIG. 3A indicates the voltage standing wave ratio (VSWR) characteristic, and FIG. 3B indicates the directional property on the X-Y plane, of the planar inverted F antenna 200 when the antenna 200 is provided on the circuit board as in FIG. 2. It is noted that FIGS. 3A and 3B indicate the results when L1 is 70 mm, H is 9 mm, the spacing between the short-circuit elements is 4 to 5 mm, the width is each of the short-circuit elements is 2 mm, the plate thickness of each antenna element is 0.4 mm, and K1=K2=70 mm in FIG. 2. It is clear from FIGS. 3A and 3B that this planar inverted F antenna 200 exhibits a favorable omnidirectional characteristic, while the bandwidth remains about 25 MHz at VSWR of 2.

The height of the radiation element 120 (height H in FIG. 1) of the planar inverted F antenna 200 with respect to the grounding element 100 cannot be increased any further, due to the size limitation of a casing of a communication module to which the antenna is to be accommodated, which hinders further extension of the bandwidth of the antenna.

SUMMARY

According to an aspect of the embodiments, an antenna includes a planar inverted F antenna including: a grounding element that defines a grounding surface; a first radiation element that is spaced apart from the grounding surface and extends in a same direction as a direction in which grounding element extends; a first short-circuit element that short-circuits the grounding element and the first radiation element and is provided at an end of the first radiation element; a second short-circuit element that short-circuits the grounding element and the first radiation element and is provided spaced apart from the first short-circuit element; a power supply section that is provided at the first short-circuit element or the second short-circuit element; and a second radiation element that is provided parallel to the grounding surface and extending partially with respect to the first radiation element in a longitudinal direction, the second radiation element being provided so as to substantially increase a width of the first radiation element in the vicinity of the power supply section.

The object and advantages of the embodiment will be realized and attained by means of the elements and combinations particularly pointed out in the claims.

It is to be understood that both the foregoing general description and the following detailed description are exemplary and explanatory and are not restrictive of the embodiment, as claimed.

DESCRIPTION OF EMBODIMENTS

(1) First Embodiment

(1-1) Structure of Planar Inverted F Antenna

Figure 4:
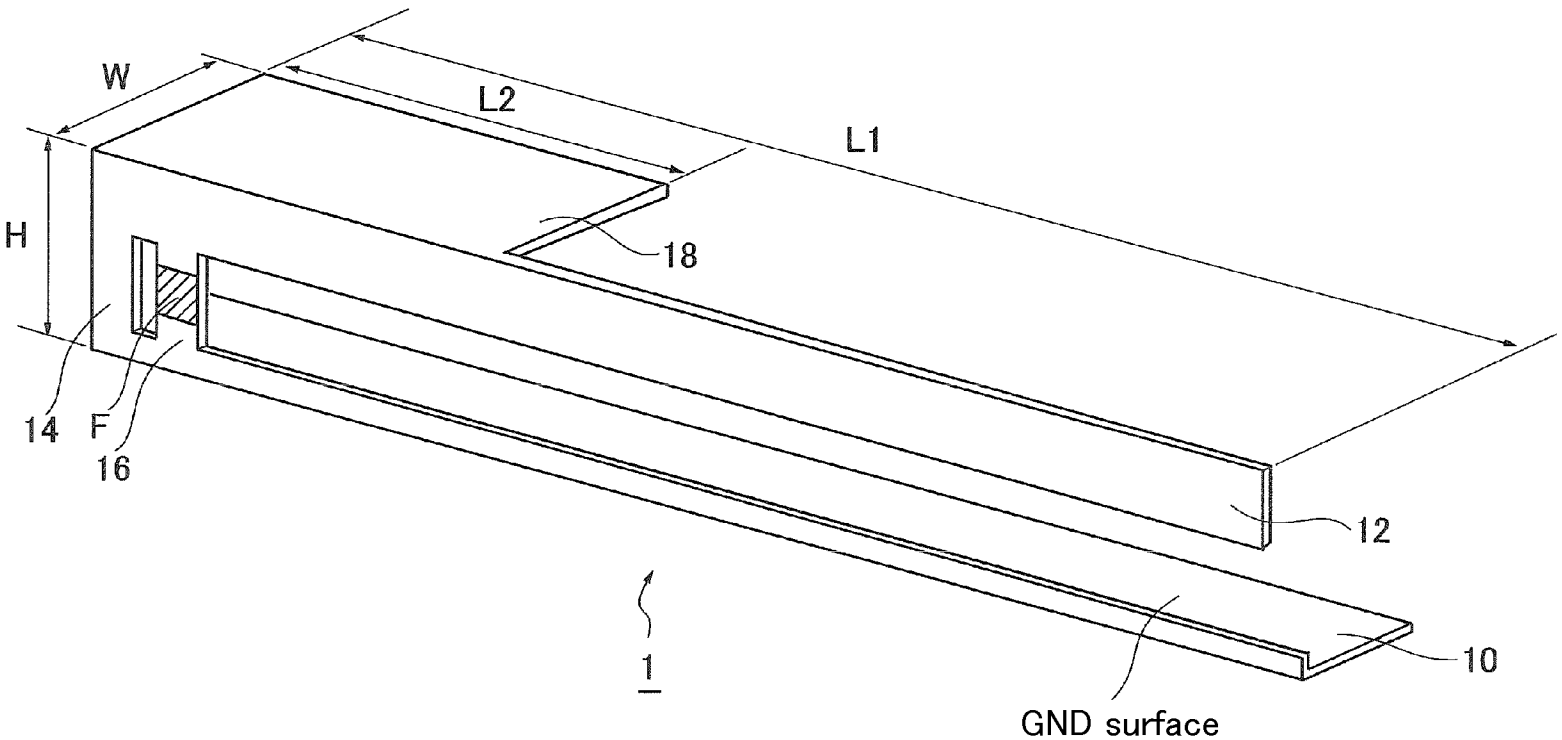
FIG. 4 is a perspective view illustrating a planar inverted F antenna of a first embodiment.
Figure 5:
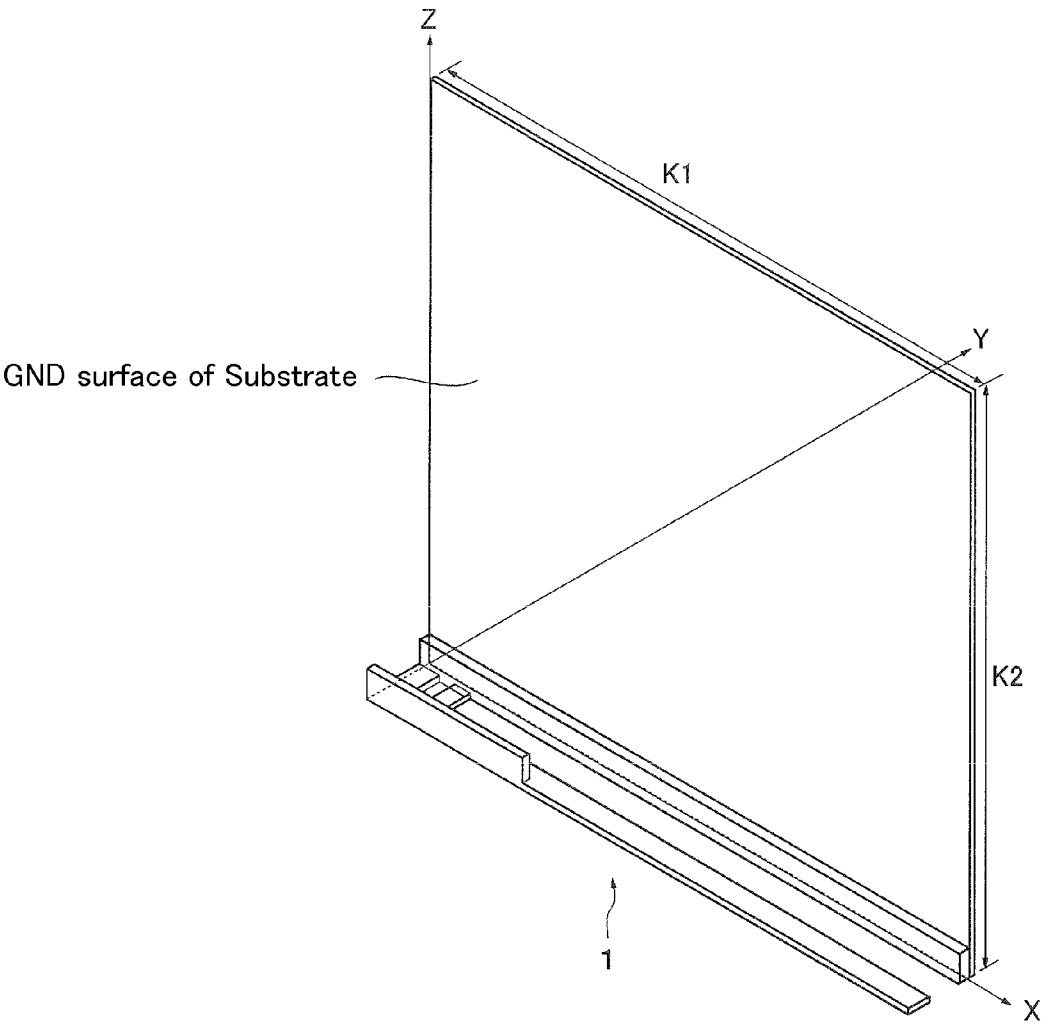
FIG. 5 is a diagram illustrating the planar inverted F antenna of the first embodiment, provided on a circuit board.

First, the structure of a planar inverted F antenna of a first embodiment will be described with reference to FIGS. 4 and 5. FIG. 4 is a perspective view illustrating a planar inverted F antenna 1 in accordance with an embodiment. FIG. 5 is a diagram illustrating the planar inverted F antenna 1 depicted in FIG. 4, provided on a circuit board of a communication module.

As depicted in FIG. 4, the planar inverted F antenna 1 of the present embodiment is a metal plate or film antenna including multiple planar elements. In other words, the planar inverted F antenna 1 includes a grounding element 10, a first radiation element 12, a first short-circuit element 14, a second short-circuit element 16, and a second radiation element 18. The material of the metal plate for the planar inverted F antenna 1 of the present embodiment is preferably a metal, such as copper and copper-nickel-zinc alloys (alloys of copper, zinc, and nickel), for example.

The grounding element 10 defines aground (GND) surface (grounding surface), which is to be attached to a GND surface of a circuit board (GND surface of the substrate) of a communication module wherein the planar inverted F antenna 1 is to be accommodated. The grounding element 10 in the longitudinal direction may have any length, as long as the length does not protrude from the area of the GND surface of the circuit board to which the antenna is to be attached. For example, for attaching the grounding element 10 of the planar inverted F antenna 1 of the present embodiment on the GND surface having a size of K1×K2 (on the X-Z plane), as depicted in FIG. 5, the length of the grounding element 10 in the longitudinal direction is equal to or smaller than K1. The planar inverted F antenna 1 may be attached at an end of the GND surface of the substrate of the circuit board so as not to interfere with other components provided on the circuit board, as depicted in FIG. 5. However, where to attach the planar inverted F antenna 1 is not limited to the particular example depicted in FIG. 5.

The first radiation element 12 extends in the same direction as the grounding element 10, while being spaced apart from the GND surface of the grounding element 10. The length L1 of the first radiation element 12 in the longitudinal direction is set to be approximately $\lambda/4$ ($L1=\lambda/4$), where $\lambda$ represents the wavelength corresponding to the operating frequency, wherein the first radiation element 12 resonates at this length. Further, in the planar inverted F antenna 1 of the present embodiment, the height of the top end of the first radiation element 12 is H, and the upper limit of the height H may be restricted by the size of the casing of the communication module wherein the planar inverted F antenna 1 is to be accommodated.

The first and second short-circuit elements 14 and 16 are elements that short-circuit the grounding element 10 and the first radiation element 12. The first short-circuit element 14 is provided at an end of the planar inverted F antenna 1. The second short-circuit element 16 is provided spaced apart from the first short-circuit element 14. In the example depicted in FIG. 4, the first and second short-circuit elements 14 and 16 are provided approximately parallel to each other. A power supply section F that applies radio frequency signals on the planar inverted F antenna 1, from a circuit board (not illustrated) through a coaxial cable, for example, is provided at either of the first short-circuit element 14 or the second short-circuit element 16. In the example depicted in FIG. 4, the power supply section F is provided at the second short-circuit element 16.

The second radiation element 18 is an element that is provided parallel to the GND surface of the grounding element 10 and extending partially with respect to the first radiation element 12 in the longitudinal direction. In other words, the relationship: $L2<L1$ holds, where L2 represent the length of the second radiation element 18, along in the longitudinal direction of the first radiation element (having a length L1). Further, in the example depicted in FIG. 4, the second radiation element 18 is provided on a plane orthogonal to the first radiation element 12.

The width of the second radiation element 18 is indicated with W in FIG. 4. The second radiation element 18 is provided so as to substantially increase the width of the first radiation element 12 in the vicinity of the power supply section F. As will be described later, this generates multiple electric current paths, the number of which depends on the width W of the first radiation element 12, when the planar inverted F antenna 1 resonates. Here, in the planar inverted F antenna 1 of the present embodiment, the surface defining the first radiation element 12 and the GND surface are orthogonal to each other, whereas the surface defining the second radiation element 18 and the GND surface are parallel to each other. Accordingly, an increased width W of the second radiation element 18 does not results in increasing the height H of the planar inverted F antenna 1, which makes the entire planar inverted F antenna 1 low profile.

(1-2) Attachment of Planar Inverted F Antenna to Substrate

Next, an exemplary attachment of the planar inverted F antenna 1 of the present embodiment will be described with reference to FIGS. 6 to 8B.

Figure 6:
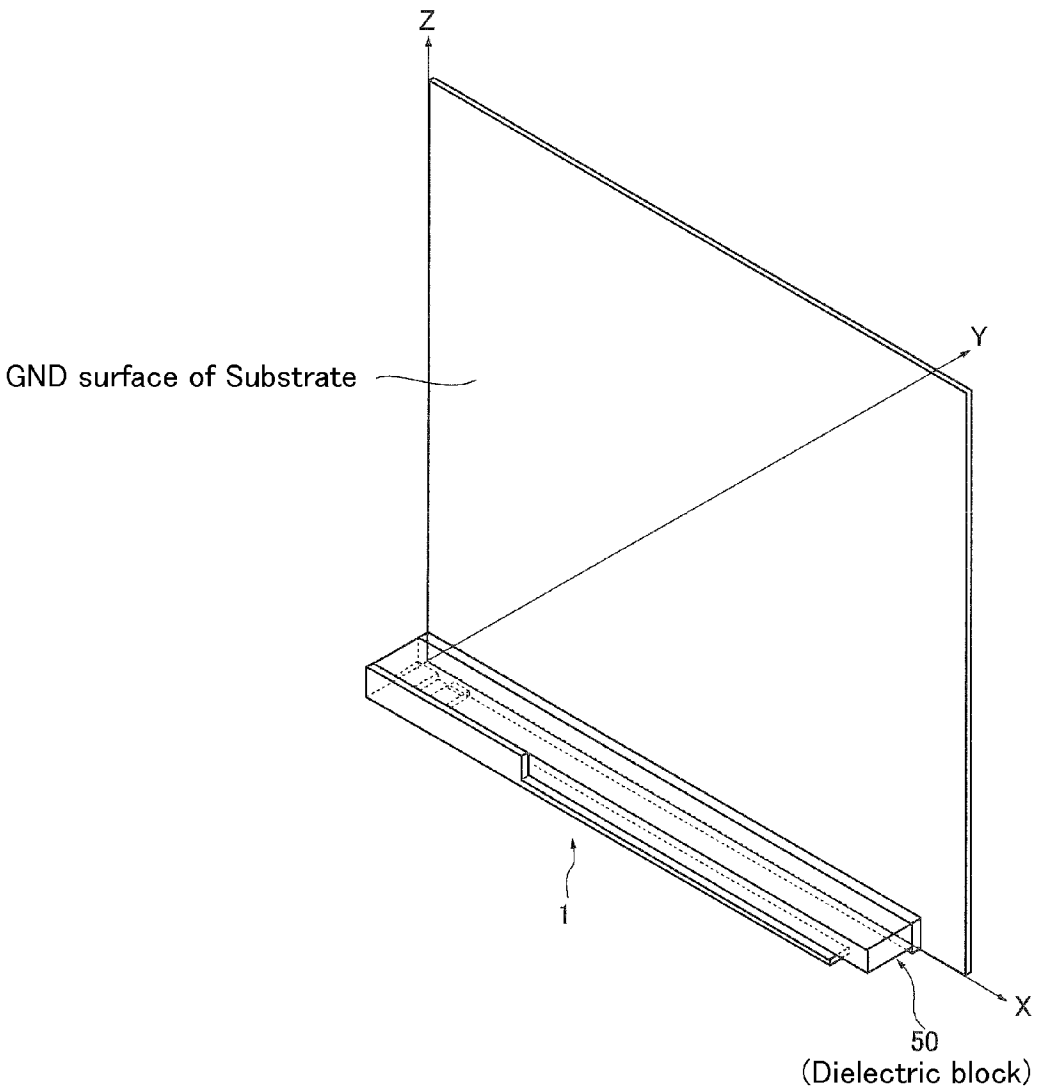
FIG. 6 is a diagram illustrating an exemplary attachment of the planar inverted F antenna of the first embodiment.

FIG. 6 is a diagram illustrating an exemplary attachment of the planar inverted F antenna 1 of the present embodiment. As depicted in FIG. 5, the planar inverted F antenna 1 of the present embodiment, when attached to the GND surface of the substrate of the communication module, the first radiation element 12 is not rigid enough to maintain its geometry depicted in FIG. 4. For maintaining the geometry, as depicted in FIG. 6, a dielectric block 50 may be inserted between the grounding element 10 and the second radiation element 18, and the first radiation element 12 may be come in contact with or attached to the dielectric block 50. In the exemplary attachment depicted in FIG. 6, the bottom of the dielectric block 50 is attached to the GND surface of the substrate with an adhesive or the like. The material of the dielectric block 50 may be a plastic, e.g., an acrylonitrile butadiene styrene (ABS), for example.

Figure 7:
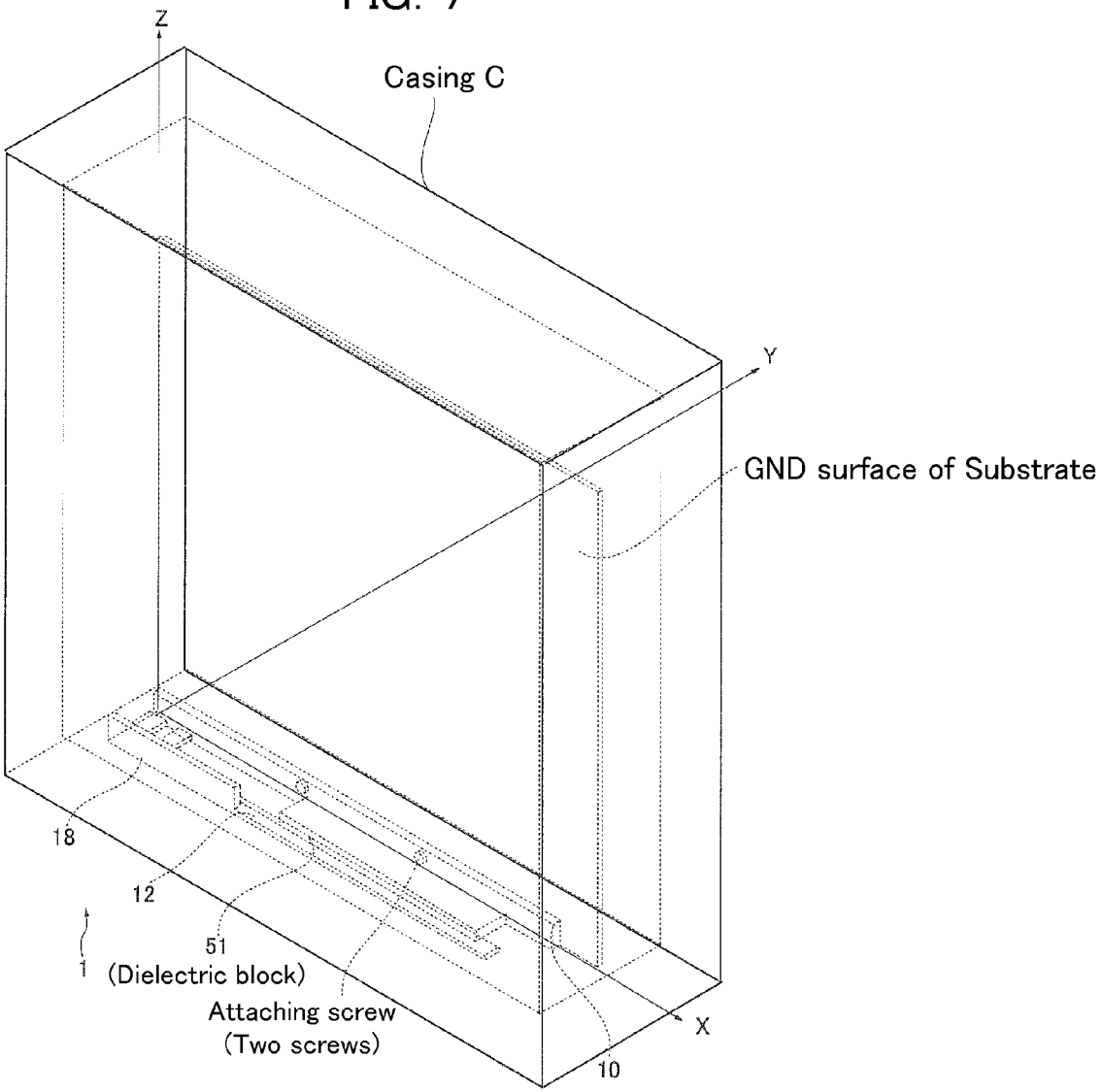
FIG. 7 is a diagram illustrating an example of the planar inverted F antenna of the first embodiment, attached to a casing of a communication module.
Figure 8A:
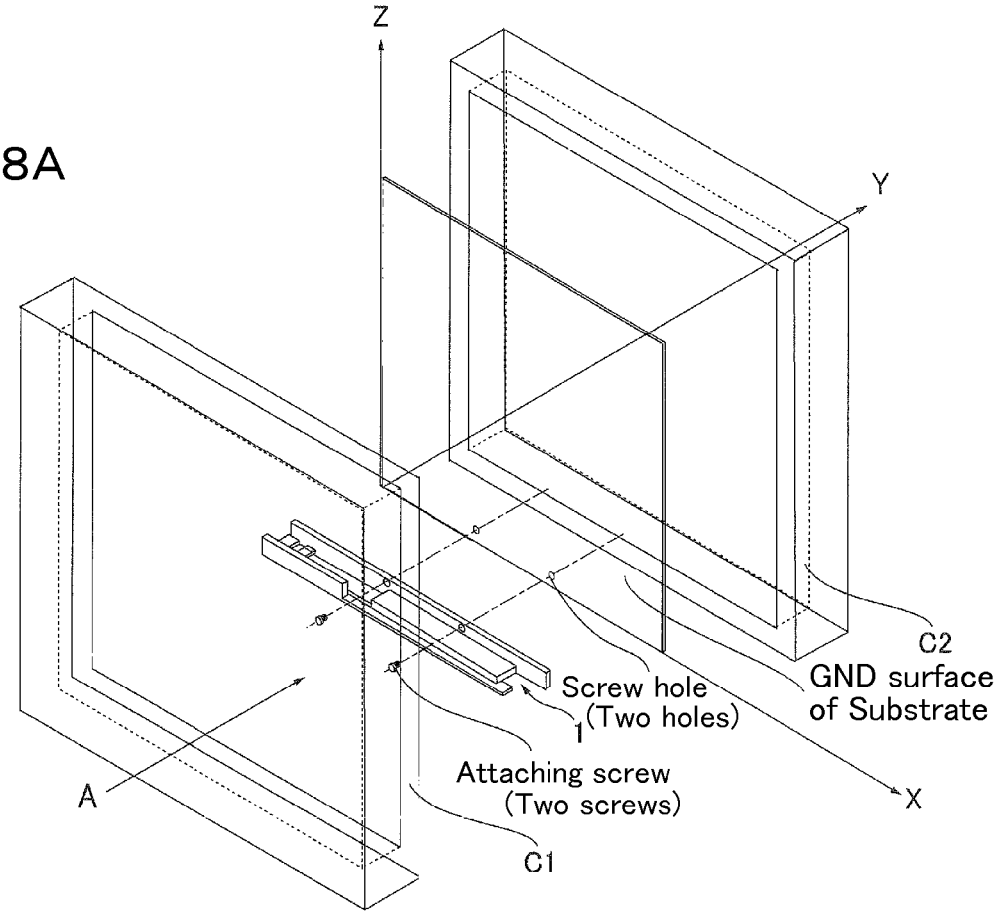
FIGS. 8A and 8B are diagrams illustrating a preferred attachment of the planar inverted F antenna of the first embodiment.
Figure 8B:
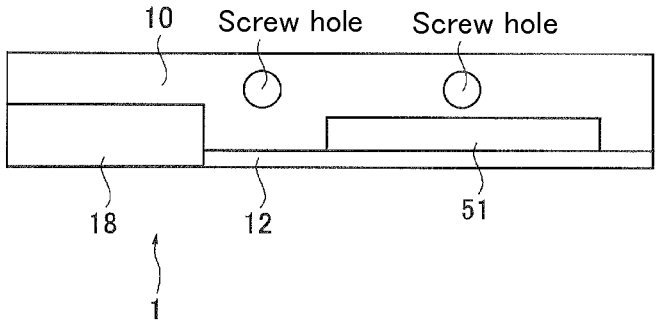

Alternatively, attachment of the planar inverted F antenna 1 of the present embodiment may be simplified by means of attaching screws, while ensuring that the geometry of the planar inverted F antenna 1 is maintained. Hereinafter, an example of how the planar inverted F antenna 1 of the present embodiment is attached to a substrate of a communication module using attaching screws will be described with reference to FIGS. 7, 8A, and 8B. FIG. 7 depicts the planar inverted F antenna 1 of the present embodiment, attached to a casing C of a communication module. FIG. 8A is an exploded view illustrating attachment for obtaining the structure depicted in FIG. 7, and FIG. 8B is an arrow view of the planar inverted F antenna 1 and the dielectric block 51 when viewed from Arrow A in FIG. 7A. In FIGS. 7, 8A and 8B, the planar inverted F antenna 1 is provided at an end of the GND surface of the substrate of the circuit board of the communication module. In FIGS. 8A and 8B, the casing C of a communication module is assembled by coupling a front-side casing C1 and a rear-side casing C2 together.

As depicted in FIG. 7, as a preparation for this attachment, the dielectric block 51 is inserted between the grounding element 10 and the second radiation element 18. Further, as depicted in FIG. 8B, the dielectric block 51 is made contact with one side of the first radiation element 12. This enables the first radiation element 12 to maintain its geometry depicted in FIG. 4. As depicted in FIGS. 8A and 8B, the planar inverted F antenna 1 and the GND surface of the substrate are each provided with two screw holes, through which attaching screws are threaded. As depicted in the arrow view A in FIG. 8B, these two screw holes are provided in the grounding element 10 of the planar inverted F antenna 1 such that the second radiation element 18 and the dielectric block 51 are spaced apart, thereby preventing the heads of the attaching screws from interfering with the second radiation element 18 and the dielectric block 51. This attachment enables easy attachment of the planar inverted F antenna 1 of the present embodiment to the GND surface of the substrate, with the attaching screws, while maintaining the geometry of the planar inverted F antenna 1 of the present embodiment.

(1-3) Operation of Planar Inverted F Antenna

Figure 9:
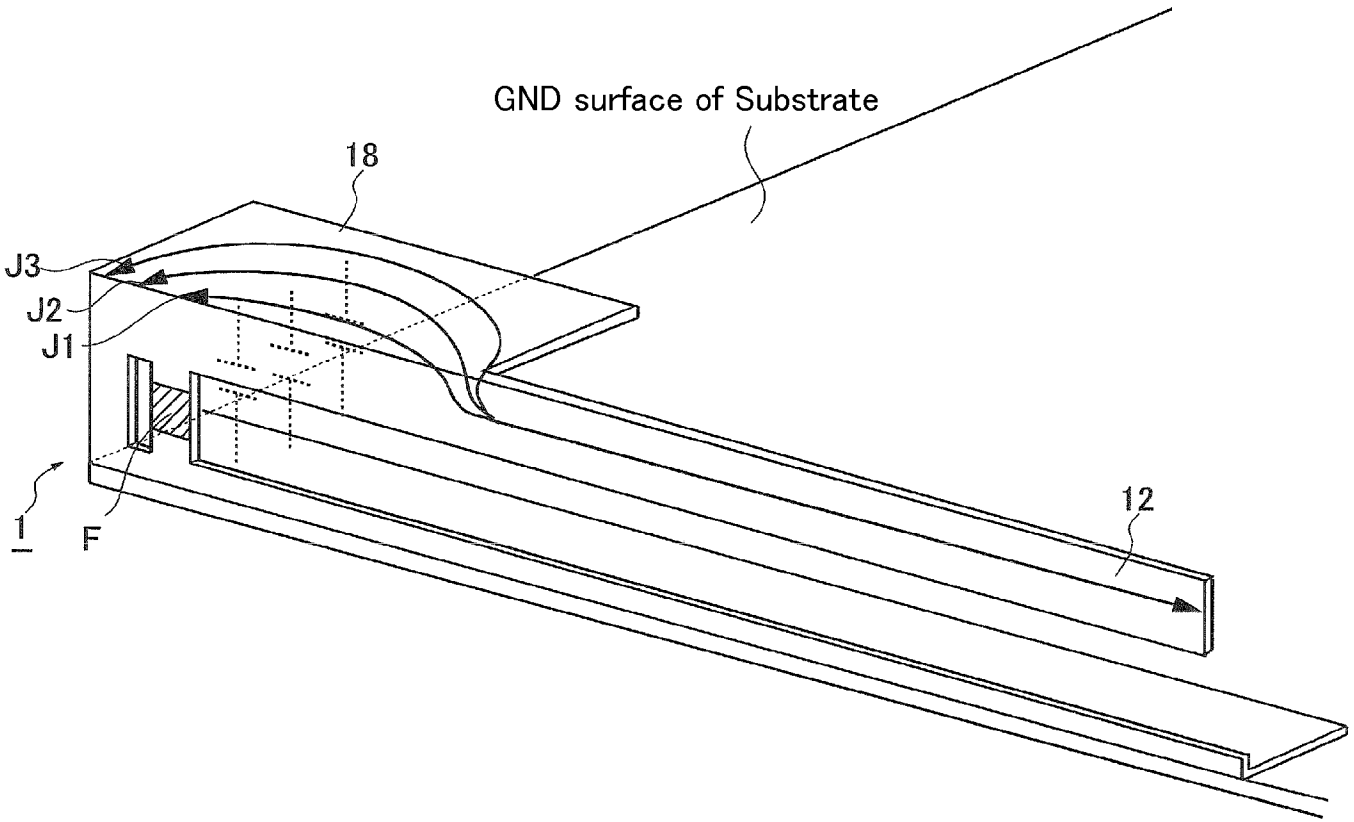
FIG. 9 is a diagram illustrating the operation of the planar inverted F antenna of the first embodiment.

Next, the operation of the planar inverted F antenna 1 of the present embodiment will be described with reference to FIG. 9. FIG. 9 is a diagram illustrating the operation of the planar inverted F antenna of the present embodiment.

If there were no second radiation element 18, the length L1 of the first radiation element 12 in the longitudinal direction would be $\lambda/4$ (L1=$\lambda/4$) and the planar inverted F antenna 1 would resonate at a resonance frequency determined by $\lambda$, similarly to conventional planar inverted F antennas. The resonance mode, in this case, is that the electric current maximizes in the vicinity of the power supply section F and drops to zero at the end of the first radiation element 12. In contrast, in the planar inverted F antenna 1 of the present embodiment, the second radiation element 18 is provided such that the width of the first radiation element 12 is substantially increased in the vicinity of the power supply section F. Thus, as depicted in FIG. 9, multiple electric current paths are generated, the number of which depends on the width of the first radiation element 12. In FIG. 9, these multiple electric currents are indicated by three virtual electric currents $J_1$, $J_2$, and $J_3$. The multiple electric currents merge in the region of the first radiation element 12 where no second radiation element 18 is provided. Since the second radiation element 18 is provided parallel to the GND surface, the capacitance between the second radiation element 18 and the GND surface is constant, for the multiple electric currents flowing on the second radiation element 18. Thus, the multiple electric currents (the electric currents $J_1$, $J_2$, and $J_3$ in FIG. 9) are regarded as equivalent electric currents operating on the signal of the same power supply section F. Since the equivalent multiple electric currents have different electric current paths while the planar inverted F antenna 1 operates, as depicted in FIG. 9, it can be regarded that the planar inverted F antenna 1 of the present embodiment equivalently have multiple resonance points, depending on the lengths of the multiple radiation elements. For this reason, the planar inverted F antenna 1 of the present embodiment can operate at an extended bandwidth.

(1-4) Characteristics of Planar Inverted F Antenna

Figure 10A:
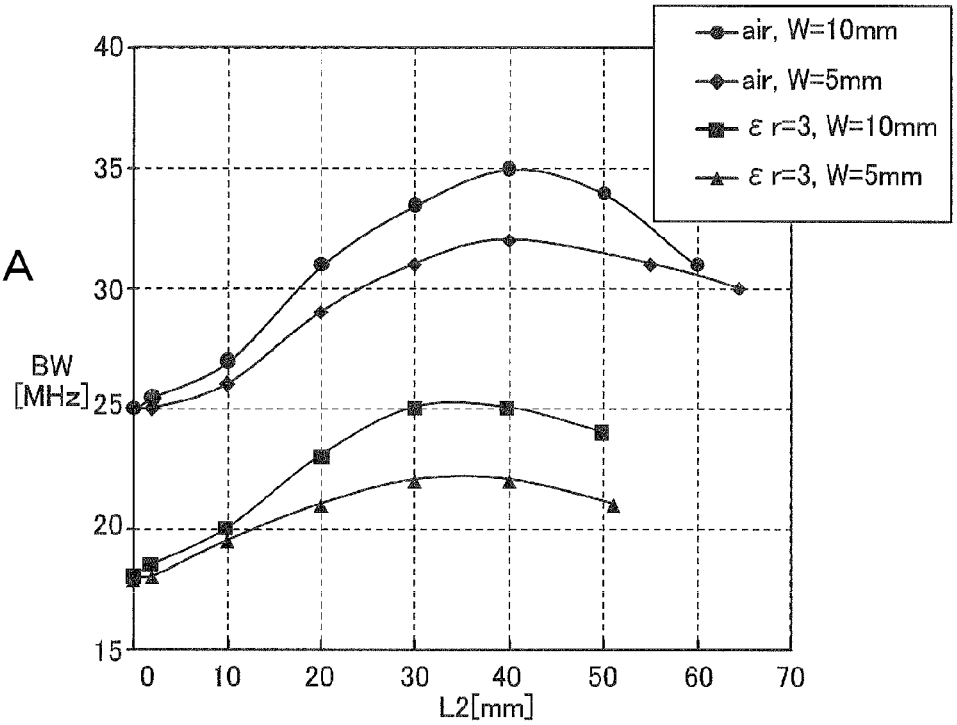
FIGS. 10A and 10B are graphs indicating an example of the characteristics of the planar inverted F antenna of the first embodiment.

Next, an example of the characteristics of the planar inverted F antenna 1 of the present embodiment with varied L1 and L2 (see FIG. 4) will be described with reference to FIGS. 10A to 11B. FIG. 10A indicates the bandwidth BW of the planar inverted F antenna 1 when the length L2 of the second radiation element 18 is varied (when VSWR=2), and FIG. 10B indicates the relationship between the length L1 of the first radiation element 12 and the length L2 of the second radiation element 18 while the antenna resonates. FIGS. 11A and 11B indicate electromagnetic field simulator results of the planar inverted F antenna 1, wherein FIG. 11A indicates the VSWR characteristic, and FIG. 11B indicates the directional property on the X-Y plane, of the planar inverted F antenna 1 of the present embodiment. It is noted that FIGS. 10A to 11B indicate results when H is 9 mm, the spacing between the short-circuit elements is 4 to 5 mm, the width is each of the short-circuit elements is 2 mm, the plate thickness of each antenna element is 0.4 mm, in FIG. 4, and K1=K2=70 mm in FIG. 5. Further, in the example depicted in FIGS. 10A to 11B, the planar inverted F antenna 1 of the present embodiment is designed as an antenna operating at a center frequency (operating frequency) of 1 GHz.

Figure 10B:
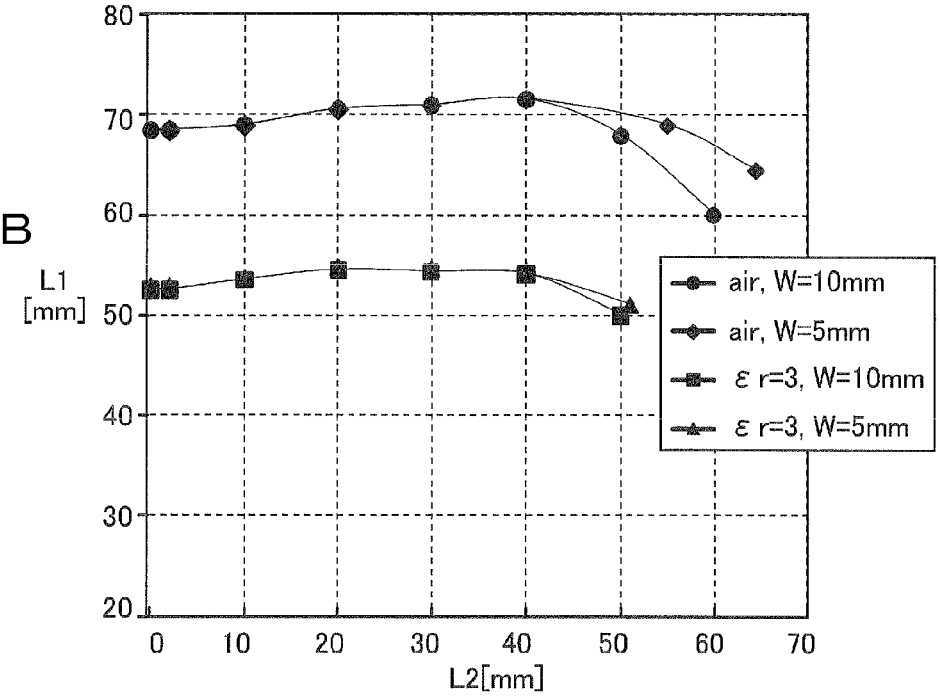
Figure 11A:
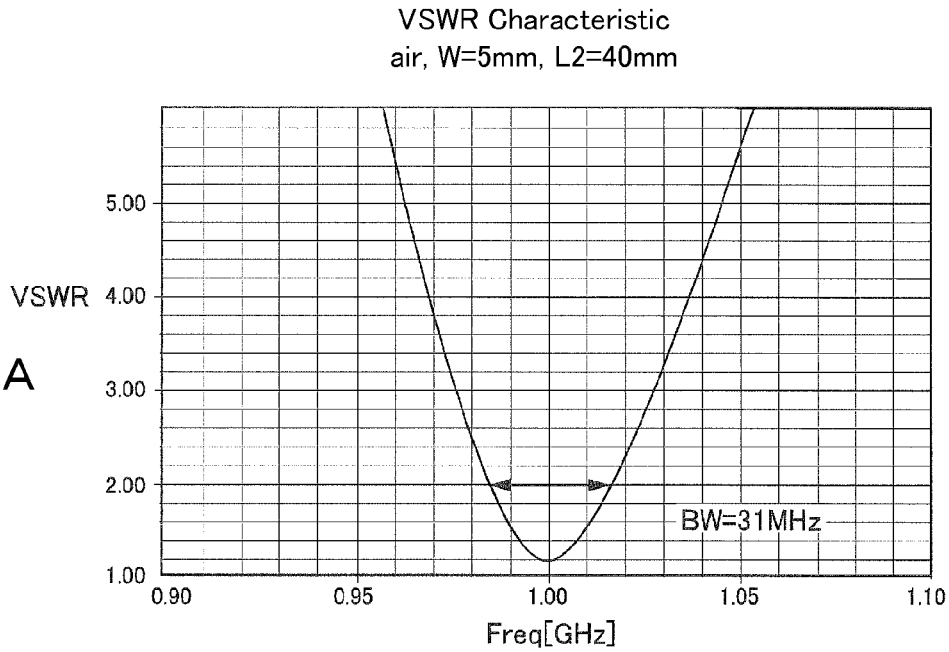
FIGS. 11A and 11B are graphs indicating an example of the characteristics of the planar inverted F antenna of the first embodiment.
Figure 11B:
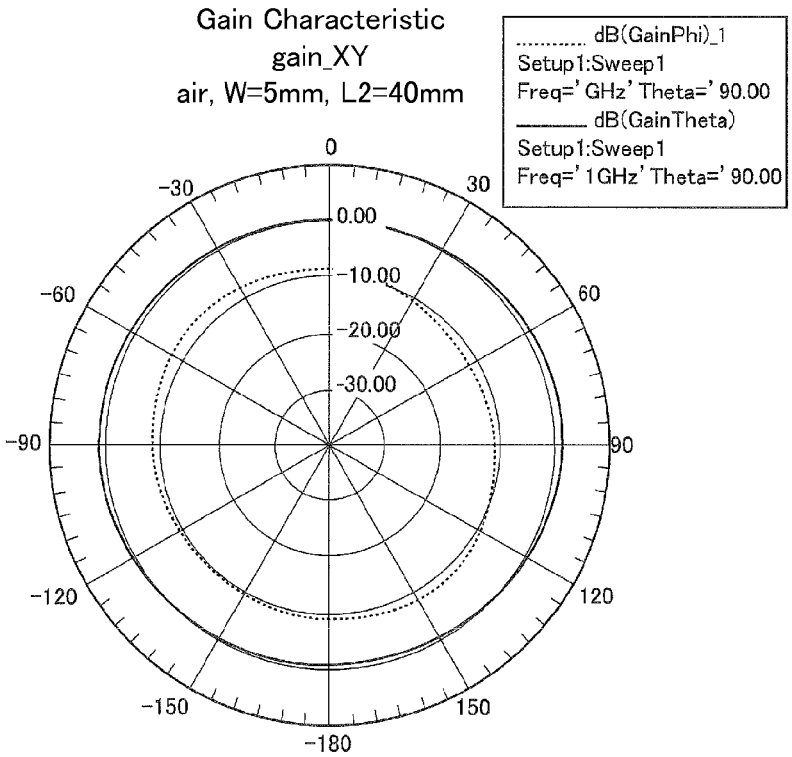

FIGS. 10A and 10B indicate the cases where no dielectric block is inserted, and where a dielectric block (having a relative dielectric constant $\in r$ of 3) is inserted, between the grounding element 10 and the second radiation element 18. Further, FIGS. 10A and 10B indicate the cases where the width W of the second radiation element 18 is 5 mm and 10 mm.

FIG. 10B indicates that the planar inverted F antenna 1 resonates at L1 of about 70 mm in the presence of the air, which corresponds to a quarter of the operating frequency $\lambda$($\lambda$=300 mm at 1 GHz). When the dielectric block (having a relative dielectric constant $\in r$ of 3) is inserted, wavelength shortening by the dielectric reduces the effective antenna length and thus the planar inverted F antenna 1 resonates at L1 of about 54 mm.

Referring to FIG. 10A, in the planar inverted F antenna 1 of the present embodiment, the bandwidth of the antenna is considerably increased as compared to the case where no second radiation element 18 is provided (L2=0 in FIG. 10B), although the bandwidth is dependent on the size of the second radiation element 18 (L2 and W). For example, the antenna bandwidth is increased by 40% (from 25 MHz to 35 MHz) in the presence of the air, when W is 10 mm and L2 is 40 mm.

FIG. 10A also indicates that the increase in the antenna bandwidth is reduced when the length L2 of the second radiation element 18 is too high. For example, when the air is present and W is 10 mm, the bandwidth BW is monotonously increased with L2, in the range of 0<L2 (mm)≤40. After reaching the peak at L2 (mm)=40, the bandwidth BW is reduced with L2, in the range of L2 (mm)>40.

This is because generation of the equivalent multiple electric currents during operation of the planar inverted F antenna 1 depicted in FIG. 9 is reduced if L2 is too long, and the characteristics approach to those of a planar inverted F antenna where a radiation element is wide across the length of the radiation element. When a radiation element is wide across the length of the radiation element, multiple resonance modes on different current paths are not generated. It is considered that the effect of equivalent multiple electric currents is still obtained even if L2 is too long, unless not L2=L1. However, the electric currents during resonance in the vicinity of the tip of the first radiation element 12 are near zero, and the equivalent multiple electric currents are not distributed effectively and accordingly their effect becomes limited.

Hence, it is possible to increase the bandwidth by provision of the second radiation element 18, and for maximizing the increase, the length L2 of the second radiation element 18 is preferably in a range of approximately from L1×¼ to L1×¾.

Further referring to FIG. 10A, the antenna bandwidth is also increased with the width W of the second radiation element 18. However, excessively increasing the width W of the second radiation element 18 may cause unintended resonance in the direction perpendicular to the first radiation element 12. In other words, where multiband operation of the planar inverted F antenna 1 of the present embodiment is not desirable, excessively increasing the width W of the second radiation element 18 may cause effects undesirable for the operation of the antenna. Further, the second radiation element 18 having an excessively increased width W may interfere with components on the substrate of the communication module wherein the antenna is to be accommodated. From the above reason, the second radiation element 18 preferably has a width of approximately λ/15 (about 20 mm at 1 GHz) or smaller.

Figure 1:
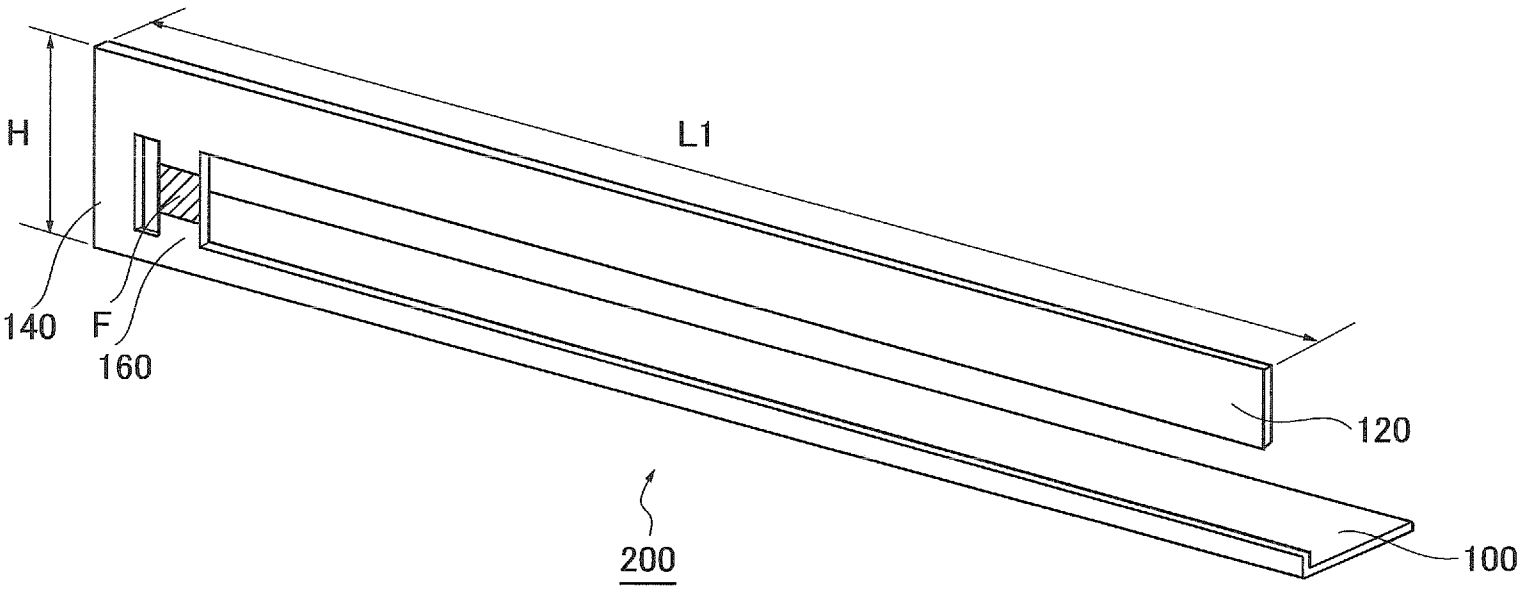
FIG. 1 is a perspective view illustrating an example of a planar inverted F antenna.
Figure 2:
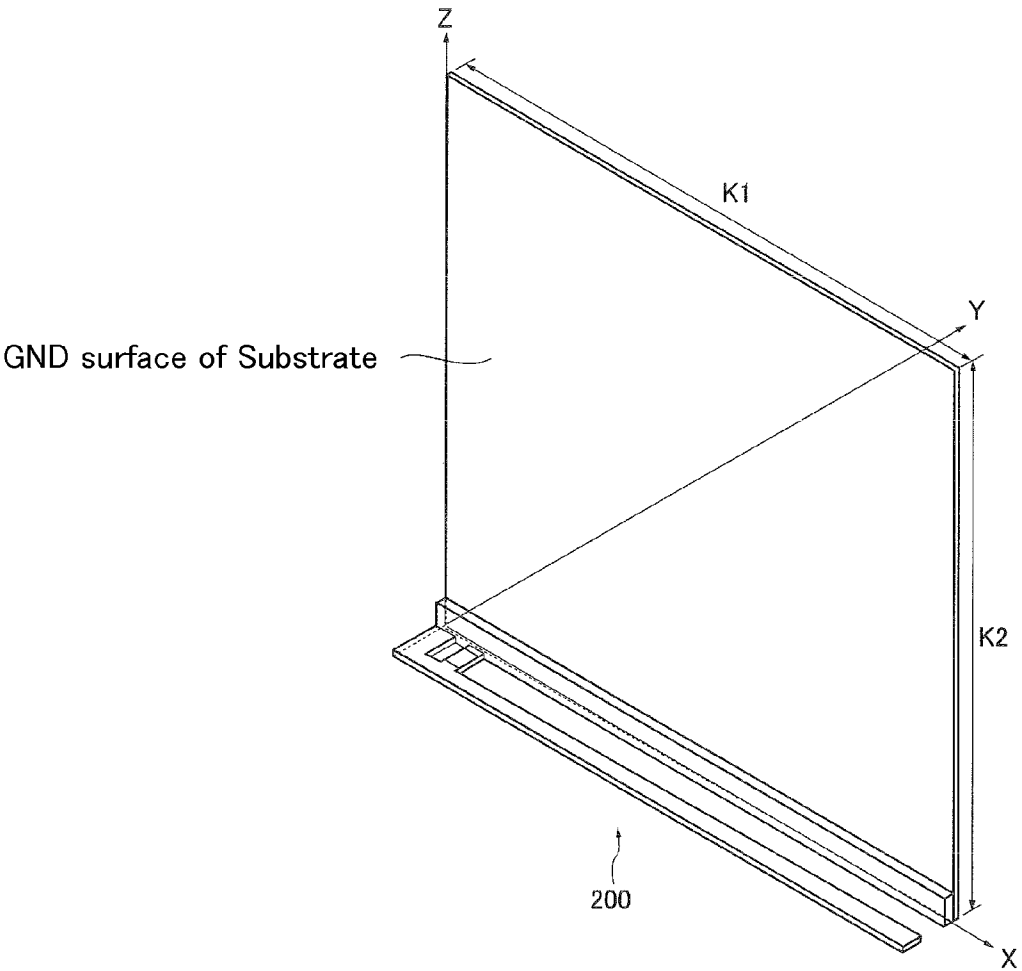
FIG. 2 is a diagram illustrating the planar inverted F antenna depicted in FIG. 1, provided on a circuit board.
Figure 3A:
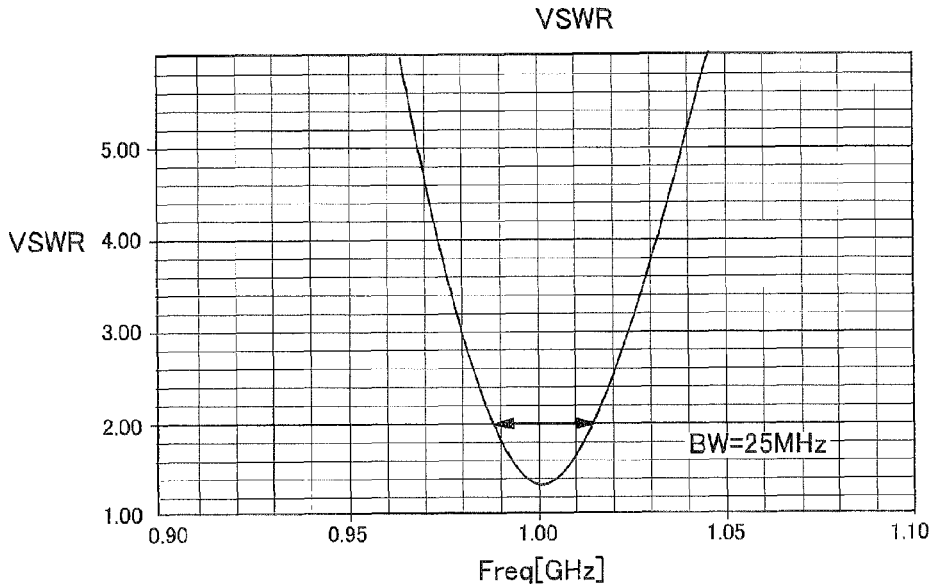
FIGS. 3A and 3B are graphs indicating an example of the characteristics of the planar inverted F antenna as depicted in FIG. 2.
Figure 3B:
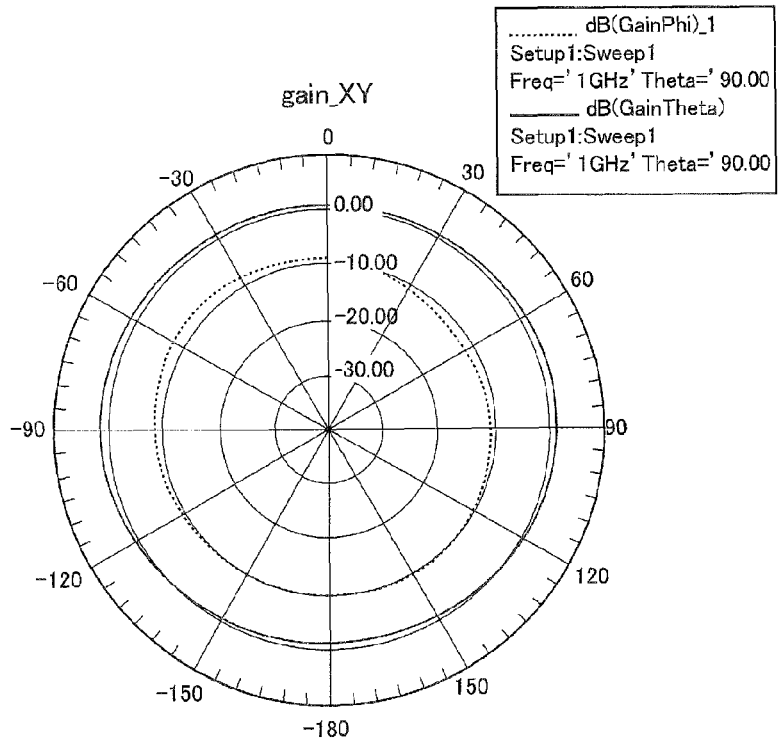

FIGS. 11A and 11B indicate an example of the characteristics of the planar inverted F antenna 1 of the present embodiment under the condition where the air is present, W is 5 mm, and L2 is 40 mm. As depicted in FIG. 11A, the bandwidth is about 31 MHz at VSWR of 2, indicating that the bandwidth is extended, as compared to the case depicted in FIG. 3. Further, FIG. 11B indicates that this planar inverted F antenna 1 has a favorable omnidirectional characteristic, similar to the characteristic depicted in FIG. 3.

As set forth above, in the planar inverted F antenna 1 of the present embodiment, the second radiation element 18 is provided parallel to the GND surface and extending partially along the longitudinal direction with respect to the first radiation element 12, so as to substantially increase the width of the first radiation element 12 in the vicinity of the power supply section F. Hence, the planar inverted F antenna 1 of the present embodiment remains low profile, as well as exhibiting an extended bandwidth.

(1-5) Variants

Other than the configuration depicted in FIG. 4, the planar inverted F antenna of the present embodiment can be modified to various configurations.

Figure 12:
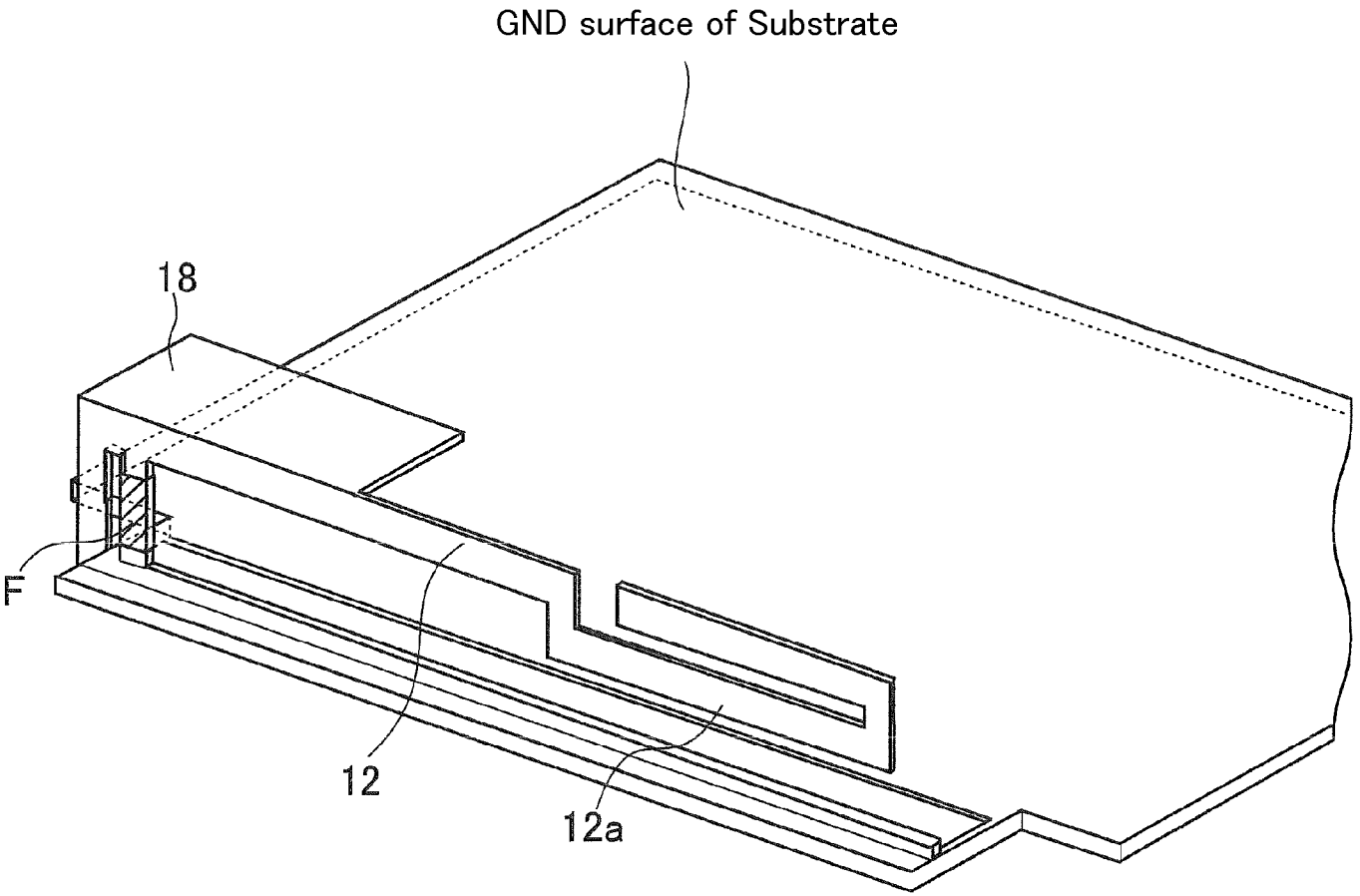
FIG. 12 is a diagram illustrating an example of a variation to the planar inverted F antenna of the first embodiment.

For example, the planar inverted F antenna 1 can be modified suitably in accordance with the size constraint of a casing of a communication module wherein the planar inverted F antenna 1 is to be accommodated. For example, as exemplified in FIG. 12, if the size of the casing is limited in the longitudinal direction of the first radiation element 12, the end of the first radiation element 12 may be folded to define a folding portion 12*a* so as to permit accommodation of the antenna within a casing of that communication module with the limited size, while ensuring a certain antenna effective length.

Figure 13:
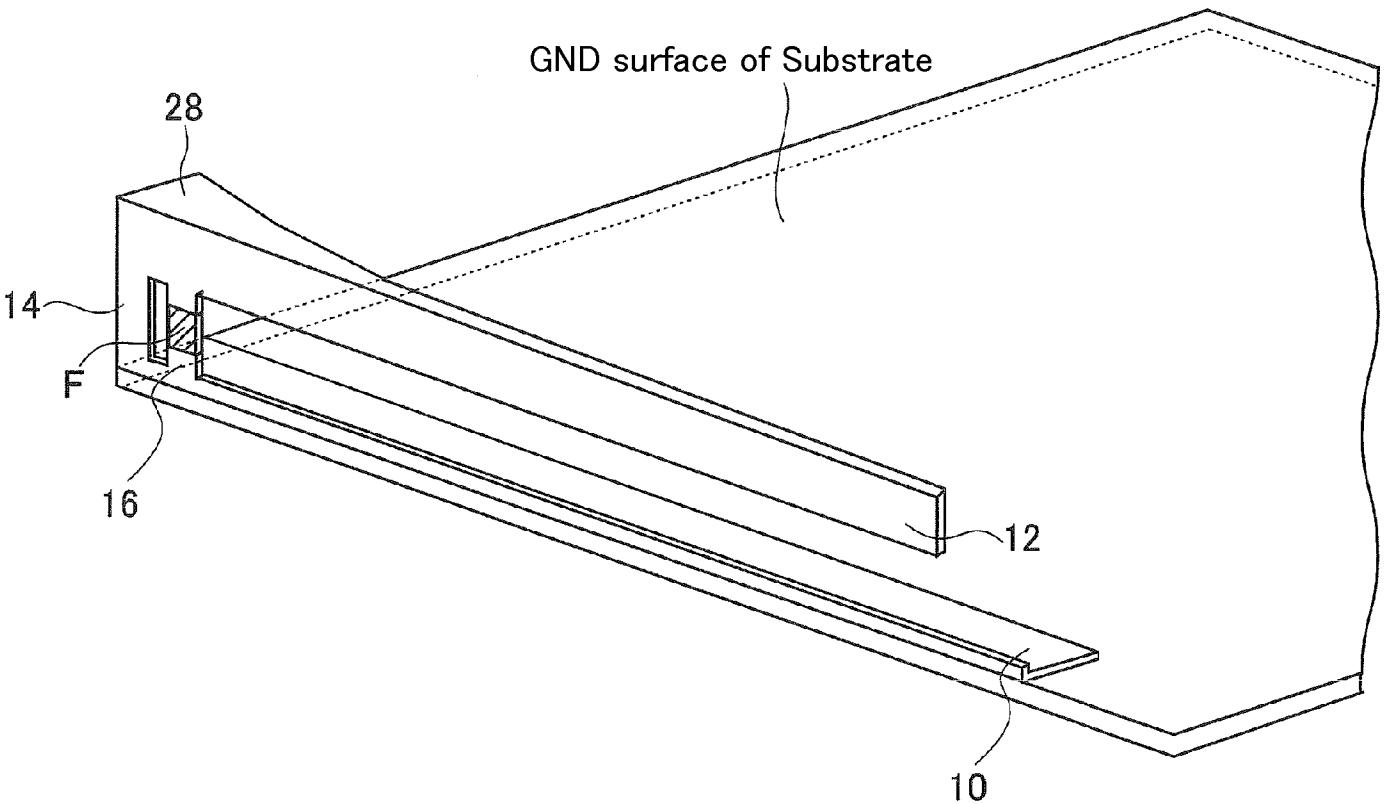
FIG. 13 is a diagram illustrating an example of a variation to the planar inverted F antenna of the first embodiment.

Furthermore, although the second radiation element is rectangular in FIG. 4, this is not limiting. The geometry of the second radiation element is not limited to a rectangle, as long as the second radiation element is provided parallel to the GND surface and extending so as to substantially increase the width of the first radiation element 12 in the vicinity of the power supply section F. One of examples wherein the second radiation element has geometry other than a rectangle is depicted in FIG. 13. A second radiation element 28 depicted in FIG. 13 has a geometry wherein the width of the second radiation element 28 is gradually reduced from the end of the first radiation element 12 on the side of the first short-circuit element 14. The second radiation element 28 depicted in FIG. 13 also satisfies the requirement that the second radiation element 28 is parallel to the GND surface and increases the width of the first radiation element 12 in the vicinity of the power supply section F.

(2) Second Embodiment

Hereinafter, a planar inverted F antenna of a second embodiment will be described.

Figure 14:
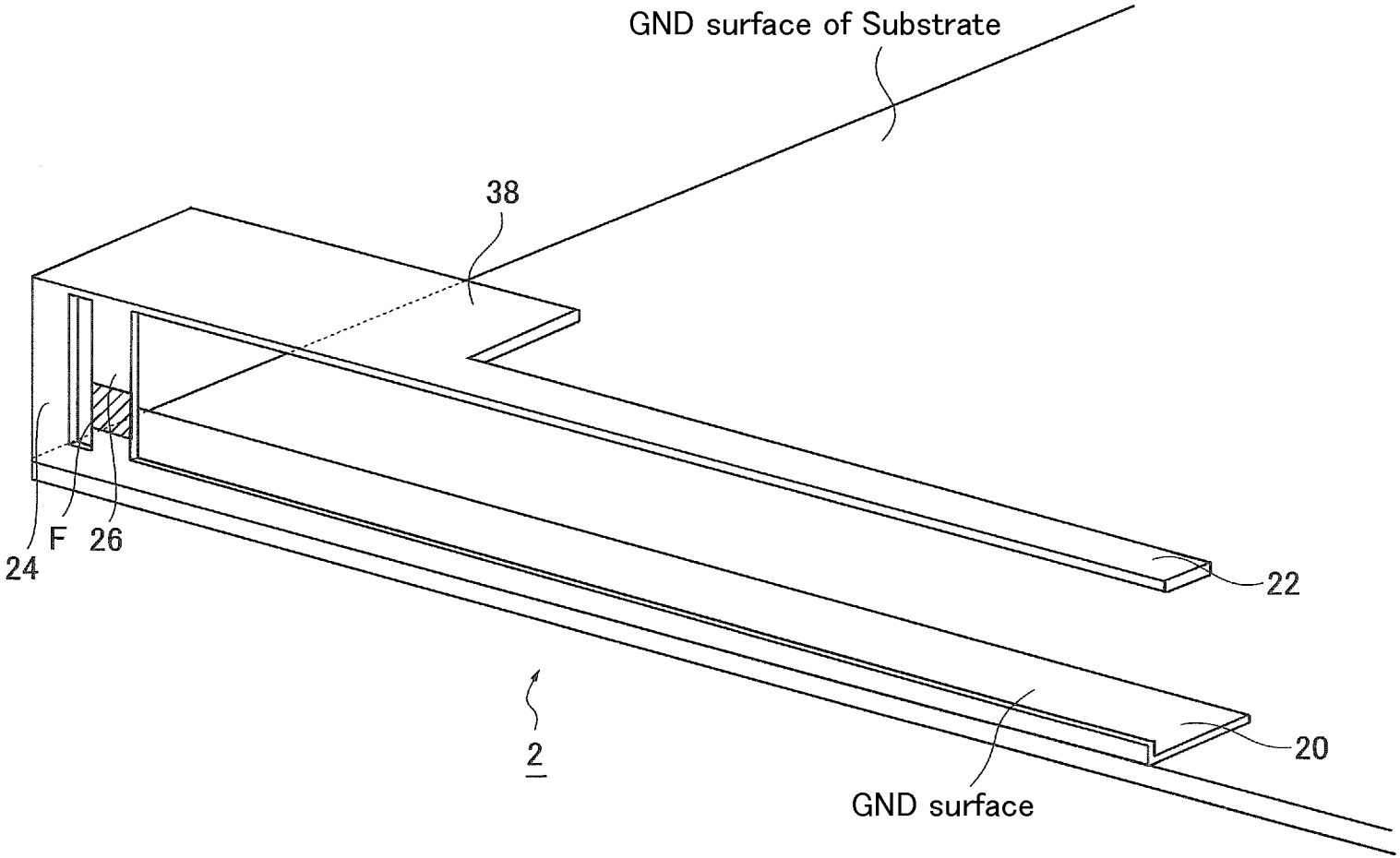
FIG. 14 is a perspective view illustrating a planar inverted F antenna of a second embodiment.

The structure of a planar inverted F antenna of the second embodiment will be described with reference to FIG. 14. FIG. 14 is a perspective view illustrating a planar inverted F antenna 2 in accordance with the second embodiment.

As depicted in FIG. 14, the planar inverted F antenna 2 of the present embodiment is a metal plate or film antenna including multiple planar elements, similar to the planar inverted F antenna 1 described above. In other words, the planar inverted F antenna 2 includes a grounding element 20, a first radiation element 22, a first short-circuit element 24, a second short-circuit element 26, and a second radiation element 38.

The grounding element 20 defines a GND surface (grounding surface), which is attached to a GND surface of a circuit board (GND surface of the substrate) of a communication module wherein the planar inverted F antenna 2 is to be accommodated.

The first radiation element 22 extends in the same direction as the grounding element 20, while being spaced apart from the GND surface of the grounding element 20. In the present embodiment, unlike the first embodiment, the first radiation element 22 is parallel to the GND surface. The length of the first radiation element 22 in the longitudinal direction is set to be approximately λ/4, where λ represents the wavelength corresponding to the operating frequency, wherein the first radiation element 22 resonates at this length. Further, in the planar inverted F antenna 2 of the present embodiment, the upper limit of the height of the top end of the first radiation element 22 from the GND surface may be restricted by the size of a casing a the communication module wherein the planar inverted F antenna 2 is to be accommodated.

The first and second short-circuit elements 24 and 26 are elements that short-circuit the grounding element 20 and the first radiation element 22. The first short-circuit element 24 is provided at an end of the planar inverted F antenna 2. The second short-circuit element 26 is provided spaced apart from the first short-circuit element 24. In the example depicted in FIG. 14, the first and second short-circuit elements 24 and 26 are provided approximately parallel to each other. A power supply section F that applies radio frequency signals on the planar inverted F antenna 2, from a circuit board (not illustrated) through a coaxial cable, for example, is provided at either of the first short-circuit element 24 or the second short-circuit element 26. In the example depicted in FIG. 14, the power supply section F is provided at the second short-circuit element 26.

The second radiation element 38 is an element that is provided parallel to the GND surface of the grounding element 20 and extending partially with respect to the first radiation element 22 in the longitudinal direction. Further, in the example depicted in FIG. 14, the second radiation element 38 is provided on the same surface as the first radiation element 22.

Similar to the width of the second radiation element 18 of the first embodiment, the second radiation element 38 of the second embodiment is provided so as to substantially increase the width of the first radiation element 22 in the vicinity of the power supply section F. This generates multiple electric current paths, the number of which depends on the width W of the first radiation element 22, when the planar inverted F antenna 2 resonates. The resonance behavior of the planar inverted F antenna 2 is similar to that of the planar inverted F antenna described in the first embodiment. Here, in the planar inverted F antenna 2 of the present embodiment, the plane on which the first radiation element 22 and the second radiation element 38 are defined is parallel to the GND surface. Accordingly, increasing the width of the second radiation element 38 does not result in an increase of the height of the planar inverted F antenna 2, which makes the entire planar inverted F antenna 2 low profile.

Adopting the configuration depicted in FIG. 14, also in the planar inverted F antenna 2 of the present embodiment, the second radiation element 38 may be provided parallel to the GND surface and extending partially along the longitudinal direction with respect to the first radiation element 22, so as to substantially increase the width of the first radiation element 22 in the vicinity of the power supply section F. Hence, the planar inverted F antenna 2 of the present embodiment remains low profile, as well as exhibiting an extended bandwidth, as in the antenna of the first embodiment.

While the embodiments of the present invention have been described in detail, a planar inverted F antenna of the present invention is not limited to the embodiments discussed above. It is noted that various modifications and variations may be practiced without departing from the spirit of the invention.

All examples and conditional language recited herein are intended for pedagogical purposes to aid the reader in understanding the invention and the concepts contributed by the inventor to furthering the art, and are to be construed as being without limitation to such specifically recited examples and conditions, nor does the organization of such examples in the specification relate to a illustrating of the superiority and inferiority of the invention. Although the embodiments have been described in detail, it should be understood that the various changes, substitutions, and alterations could be made hereto without departing from the spirit and scope of the invention.

What is claimed is:

1. A planar inverted F antenna comprising:

a grounding element that defines a grounding surface;

a first radiation element that is spaced apart from the grounding surface and extends in a same direction as a direction in which grounding element extends;

a first short-circuit element that short-circuits the grounding element and the first radiation element and is provided at an end of the first radiation element;

a second short-circuit element that short-circuits the grounding element and the first radiation element and is provided spaced apart from the first short-circuit element;

a power supply section that is provided at the first short-circuit element or the second short-circuit element; and a second radiation element that is provided parallel to the grounding surface and extending partially with respect to the first radiation element in a longitudinal direction, the second radiation element being provided so as to substantially increase a width of the first radiation element in the vicinity of the power supply section, the second radiation element whose length in a width direction of the first radiation element is equal to or shorter than one-fifteenth of a wavelength corresponding to an operating frequency.

2. The planar inverted F antenna according to claim 1, wherein the second radiation element is provided on a plane orthogonal to the first radiation element.

3. The planar inverted F antenna according to claim 1, wherein the second radiation element is provided on a same surface as the first radiation element.

4. The planar inverted F antenna according to claim 1, wherein a length of the second radiation element in the longitudinal direction ranges from L1×¼ to L1×¾, where L1 represents a length of the first radiation element in the longitudinal direction.

5. The planar inverted F antenna according to claim 1, wherein the second radiation element is a rectangular element provided extending along the longitudinal direction of the first radiation element, from the end of the first radiation element at which the first short-circuit element is provided.

6. The planar inverted F antenna according to claim 1, wherein the second radiation element is an element provided such that a width of the second radiation element decreases as the second radiation element extends along the longitudinal direction of the first radiation element, from the end of the first radiation element at which the first short-circuit element is provided.

7. The planar inverted F antenna according to claim 1, further comprising a dielectric block provided between the first radiation element and the grounding element.

8. The planar inverted F antenna according to claim 1, wherein the second radiation element whose length in the longitudinal direction of the first radiation element is between one-tenth of the wavelength and one-sixth of the wavelength.

* * * * *